United States Patent [19]

Nishijima

[11] 4,170,445

[45] Oct. 9, 1979

[54] APPARATUS FOR FORMING SEAL LINER IN CROWN SHELL

[75] Inventor: Kunihiro Nishijima, Okayama, Japan

[73] Assignee: Uchiyama Kogyo Kaisha, Ltd., Okayama, Japan

[21] Appl. No.: 833,766

[22] Filed: Sep. 16, 1977

[51] Int. Cl.[2] ..... B29C 13/02

[52] U.S. Cl. ..... 425/126 R; 425/127; 425/356; 425/348 R; 425/809

[58] Field of Search ..... 425/125, 126 R, 127, 425/349, 356, 809, 348 R

[56] References Cited

U.S. PATENT DOCUMENTS

| | | | |
|---|---|---|---|
| 1,053,898 | 2/1913 | Bogdonffy | 425/809 X |
| 2,745,135 | 5/1956 | Gora | 425/297 X |
| 2,930,081 | 3/1960 | Wilckens et al. | 425/809 X |
| 2,954,585 | 10/1960 | Simpson | 425/809 X |
| 3,877,497 | 4/1975 | Busi | 425/809 X |
| 3,963,396 | 6/1976 | Shotbolt et al. | 425/809 X |

*Primary Examiner*—Robert L. Spicer, Jr.
*Attorney, Agent, or Firm*—Dressler, Goldsmith, Clement, Gordon & Shore, Ltd.

[57] ABSTRACT

A machine for forming sealing liners of thermoplastic materials in crowns, which includes a crown carrier and a press drum. Crowns are disposed on the crown carrier and are directed to the press drum by a transfer plate that directs the crowns from the carrier to the drum. The molding of the plastic liner takes place only on the press drum.

2 Claims, 3 Drawing Figures

18
22
21
20C
14
20
20B
26
10
20A
12
12
16
24

12
31

APPARATUS FOR FORMING SEAL LINER IN CROWN SHELL

This invention relates to a machine for forming sealing liners of thermoplastic materials in crown type caps, such as those used for sealing bottles, jars, and the like. These machines are usually operated continuously at high speeds to obtain optimum efficiency.

There are machines currently on the market that are capable of forming plastic liners in crowns, and for information regarding a machine of this type reference is made to U.S. Pat. No. 3,135,019, entitled "Machine for Applying Sealing Liners of Thermoplastic Material to Bottle Caps, or the Like."

Machines of the type disclosed in the aforementioned patent essentially employ a turntable conveyor, which along its periphery defines a series of circumferentially spaced outwardly open cap receiving notches. Caps in which liners are to be inserted are directed to the conveyor receiving notches in an upwardly disposed position to receive a measured amount of plastic material. Provision is made to heat the crown and the plastic material disposed thereon while it is still on the conveyor. Located adjacent the crown conveyor and positioned to positively engage a crown while on the conveyor is a turret containing a number of plungers that are operated to sequentially form the plastic material into a liner and then withdraw a crown from the conveyor by means of the interaction between the plunger arrangement located on a turret and the conveyor. It can be appreciated that since this type of machine operates at very high speeds there must of necessity be very precise alignment between the conveyor and the turret on which the plunger drums are located. It the precise alignment is not present and maintained, then obviously many disadvantages will ensue. For example, if the plungers do not accurately and positively engage the crowns while on the conveyor it may not function to positively transfer the crowns from the conveyor to the turret. Also, continued contact between the plungers and crowns while on the crown carrier results in wearing away of the notches on the crown shell carrier which will of course further aggravate the problem. In addition, any lack of precise alignment may result in scratching the inner surface of the crowns. Furthermore, if there is any wearing of the sprockets on the crown, the crown will not be properly positioned to receive the plunger with the result that crown destruction and damage to the plunger may occur.

It is thus obvious that if a system could be set up that would not require the precise alignment of all the turret plungers with respect to the crown conveyor, then a simpler, less costly, but highly efficient system would be available. This can be best accomplished if the liner is not formed to any degree at the supporting notch on the conveyor.

It is the aforementioned principal disadvantage requiring precise plunger and conveyor alignment that the present invention overcomes. That is, when utilizing the present invention, there is no need to have the precise alignment heretofore necessary between the sprockets on the crown shell conveyor or carrier and the plungers on the turret or press drum, since the plungers do not engage the crowns until they have been completely transferred to the press drum. The movement of the crowns from the carrier to the drum is effected by a transfer mechanism which positively directs the crowns disposed on the crown shell carrier into the prescribed notches in the press drum. In this way, the need for precise alignment between the plungers and the sprockets on the crown shell carrier is obviated. Put another way, the plungers only engage the crowns after they have been transferred off of the carrier and onto the drum notches that are in positive alignment with the plungers.

In order to have a full understanding of the apparatus to which the present invention applies, a brief description of the functions of the various parts is provided. Essentially, crowns are directed through a chute into receiving notches of a crown shell carrier whereon they receive a pellet of plastic material. While on the continuously moving carrier, the crown and plastic pellet are heated and moved into a position adjacent a press drum assembly to where the crown is to be transferred and the plastic charge formed into a crown sealing liner. When the individual crowns reach an area adjacent to the press drum assembly, the succeeding crowns are engaged by a transfer plate which moves the crowns from the crown shell carrier into crown receiving notches provided on the press drum. Located on the press drum are a plurality of forming plungers identical in number to the notches on the press drum. The vertical movement of the plungers is controlled by a suitably provided cam mechanism so that the plungers which are multipart devices engage a crown disposed therebeneath and throughout a period of travel move progressively downward to mold the pellet of plastic located therein into a liner. The form of the liner is determined by the plunger design configuration which is designed to give it a particular shape yet prevent the plastic material from moving up the sidewalls of the crown.

Further advantages of the present invention will be seen from the description of the following drawings in which.

Figure 1:
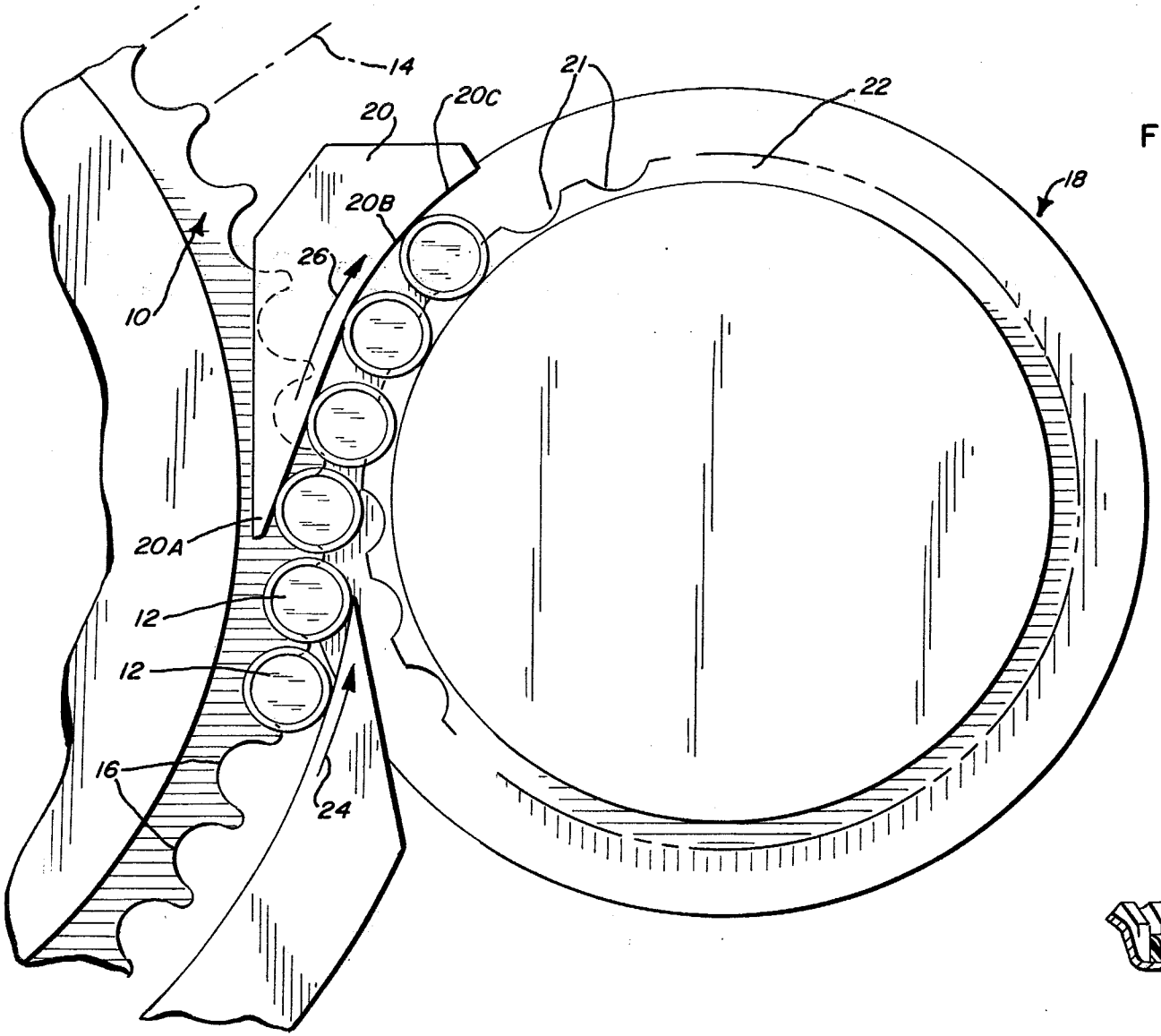
FIG. 1 is a plan view showing in schematic form a crown shell carrier and an associated press drum with the transfer mechanism located therebetween.

Referring specifically to FIG. 1, there is illustrated a crown shell carrier 10 which receives crown shells 12 placed therein in an upward direction through a schematically illustrated conventional chute 14. The crowns 12 located on the shell carrier 10 are directed past a mechanism (not illustrated) wherein a measured pellet 11 (see FIG. 2) of seal forming plastic material is disposed. The crown 12 and plastic material which is still on the crown carrier 10 is heated to facilitate subsequent liner formation. The details of these mechanisms are not illustrated and are not important to an understanding of the present invention. However, for representative devices capable of performing this function, attention is directed to U.S. Pat. No. 3,135,019.

The crown shells 12 are located in the supporting notches 16 of the crown carrier and when the crowns reach a position in general alignment with a plane passing through and including both the axis of the crown carrier 10 and a press drum 18, they come into contact with a transfer plate 20 which directs the crowns into notches 21 on the position setting plate 22 of the press drum 18. The shape of the notches on both the shell carrier and press drum are substantially identical. It is to be noted that the counterclockwise rotation of the crown shell carrier is illustrated at arrow 24 and the clockwise rotation of the press drum is illustrated at arrow 26.

The transfer plate 20 is generally triangular and the nose end 20A thereof is located adjacent the line passing through the axes of both the crown carrier and the press drum. The guide surface 20B of the transfer plate directs the crowns into the notches 21 of the press drum and terminates in an arc 20C generally concentric with the press drum. The distance between the arc 20C and oppositely disposed drum receiving notch 21 is generally equal to the diameter of the crown 12 in which the liner is being formed.

On the press drum 18 are provided a plurality of circumferentially spaced molding plungers 30. These plungers are biased into contact with the thermoplastic material in the crowns as the drum turns and they dwell in molding contact with the liner material a length of time sufficient to assure setting of the resilient molded seal liner. The crown carrier, press drum, cap supplying means, etc., are well known in the art and the details are not important to an understanding of the present invention. In addition, there are suitable conventional drive mechanisms (not illustrated) provided so that the crown carrier and drum rotate in synchronized relation to each other. Also, there is a conventional framing mechanism provided for supporting the crown carrier and press drum apparatus.

It is of particular importance to note that the axes of the crown shell carrier 10 and the press drum 18 are sufficiently spaced so that there is a space greater than the diameter of the crowns provided between the notches of the shell carrier and press drum when they are in position adjacent to one another. The spacing between the carrier and the drum and the transfer plate 20 must be correlated so that the transfer plate 20 will easily and efficiently transfer the crowns from the notches 16 of the carrier 10 to the notches 21 of drum 18. Essentially, the rpm. of the carrier 10 moving in the counterclockwise direction is correlated to that of the press drum rotating clockwise, so that the crowns moving on the carrier will quickly, accurately, and efficiently be moved from the carrier to the drum through the directed movement of the transfer plate 20.

As above mentioned, after the crown 12 and included pellet 11 are moved from the carrier, notches 16 to the drum notches 21, the drum plungers 30 act to engage the crowns 12 to form the pellets 11 into resilient plastic sealing liners 31.

Figure 2:
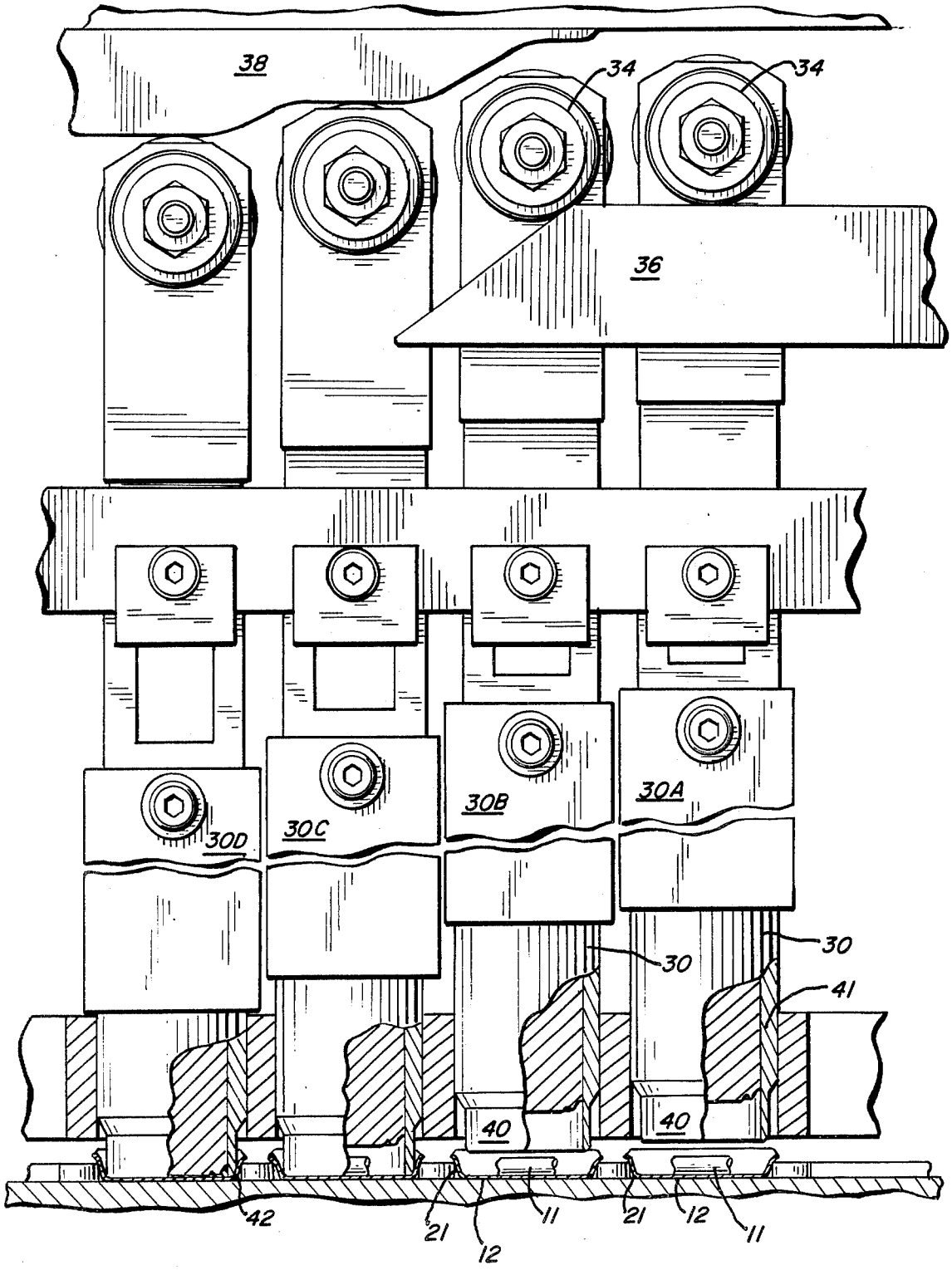
FIG. 2 is a partial elevation view showing the plunger operation relative to the plastic material located in the crown to form a plastic liner therein.

Turning to FIG. 2, there is shown a partial view of the circumferentially disposed plungers 30 which are disposed above each drum notch 21 along with a series of successive plungers showing their position during the liner formation process. Specifically, located on the press drum are a plurality of circumferentially spaced plungers 30 equal in number to the drum notches 28. These plungers are located immediately thereabove. The cam travel mechanisms provided for controlling the movement of the plungers are partially shown in FIG. 2. Briefly, there are illustrated a series of four plungers 30A, 30B, 30C, 30D, which are shown in various positions of downward travel during which they mold the plastic pellet into a liner. It can be seen that when the cam rollers 34 of the plungers 30 move out of engagement with the cam rail 36 they are biased downwardly by cam 38 to compress the pellet located in the crown 12. Additional camming structures are provided at other points around the press drum (not shown) to return the plungers to an upward condition to permit the lined crowns to be removed from the press drum, inspected, and then boxed and shipped. The plungers then re-engage the upper surface of the rail 36 so that they can then be in position to mold another pellet into a liner.

It is briefly noted that the forming plungers include a center plunger member 40 and an outwardly located knife-edged fender sleeve 41 that is disposed in the crown as shown at 42 to prevent the plastic material from moving up the sidewalls of the crown during the formation process. Essentially, the downward stroke of the plunger first operates the knife-edged fender sleeve of the molding head into the cap contiguous into the sidewalls. After this occurs, the center of the plunger engages the soft measured amount of thermoplastic material to form a sleeve liner in adhered relation to the crown shell. It is noted that the formation of the liner is determined by the configuration of the undersurface of the plunger, and this, of course, can be varied as desired.

Figure 3:
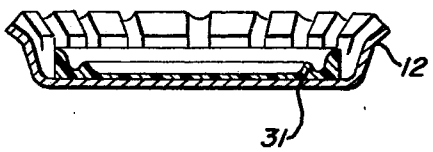
FIG. 3 is an illustration of a crown shell with a plastic liner disposed therein.

A completed crown shell showing a seal liner disposed therein is illustrated in FIG. 3.

During the operation of the novel apparatus the crowns 12 and associated pellet 11 located on the crown carrier 10 are moved in a counterclockwise direction to where they come into contact with the nose portion 20A of the transfer plate 20. The crowns are then guided off of the carrier 10 and into the notches 21 of the press drum 22. After they are located on the press drum 22, which is moving clockwise, the plungers 30 are acutated by the cam 38 to move the plungers downwardly into the crown to form the thermoplastic material in the crown into a liner 31.

It is, of course, intended to cover by the appended claims all such modifications that fall within the true spirit and scope of the invention.

What is claimed is:

1. A machine for forming moldable thermoplastic material into a seal liner in the inside of a crown, comprising: a rotatably mounted crown shell carrier having a first set of circumferentially spaced notches defining a plurality of sockets open to the periphery thereof for receiving crowns and moving said crowns to a dispensing station to receive a measured amount of thermoplastic material and subsequently to a heating station where said crowns and thermoplastic material are heated while on said crown shell carrier, a press drum defining a second set of circumferentially spaced crown-receiving notches for receiving said crowns from said crown shell carrier, said press drum being disposed adjacent the crown shell carrier and being rotatably mounted on an axis parallel to and laterally spaced from the axis of rotation of the crown shell carrier to partly define a transfer means-receiving space therebetween, each of said notches of said first and second sets having a radially inward middle portion, said sprockets of said crown shell carrier being spaced from said notches on said press drum, the minimum distance between the radially inward middle portions of said sprockets of said crown shell carrier and said notches of said press drum is substantially greater than the maximum diameter of said crown but substantially less than twice the maximum diameter of said crown for substantially preventing each of said crowns from concurrently engaging said sprockets of said crown shell carrier and said notches of said press drum, said press drum and said crown shell carrier each having a periphery adjacent the outer extremity of their notches, the peripheries of said crown shell carrier and said press drum being spaced from each other, the minimum spacing between the peripheries of said crown shell carrier and said press drum being less than the maximum diameter of a said crown for generally maintaining said crowns in engagement with only one of said sets of notches during transfer of said crowns from said crown shell carrier to said press drum, said press drum having a plurality of reciprocable molding plungers on said drum in alignment with the crown-receiving notches on said press drum, drive means for rotating the crown shell carrier in synchronism with said press drum, transfer means located adjacent a line between said axes of said crown shell carrier and said press drum and positioned in the transfer means-receiving space between the crown shell carrier and the press drum, said transfer means including a guide surface facing generally towards said press drum for guiding and directing the crowns from the sprockets on the crown shell carrier to the notches on the press drum generally before said plungers engage said crowns, and plunger positioning means operatively associated with said press drum for positioning said plungers to moldably engage said thermoplastic material contained in each of said crowns only after said crown has been completely transferred and spaced from said sprockets of said crown shell carrier and guided onto said notches of said press drum and for maintaining said plungers in molding engagement with said thermoplastic material for a sufficient period of time on said press drums to mold the thermoplastic material therein into a resilient sealing liner and allow said resilient sealing liner to set.

2. A machine in accordance with claim 1 wherein said guide surface of said transfer means is stationary and defines a directing surface, said directing surface including an arcuate portion having a radius greater than the periphery of said press drum, said arcuate portion being positioned substantially concentrically to the press drum, and the distance between said arcuate portion and the radially inward middle portion of said drum receiving notches being generally equal to the diameter of the crown in which the liner is being formed.

* * * * *